United States Patent [19]

Fawess

[11] 3,949,436

[45] Apr. 13, 1976

[54] TORSO SUPPORT

[75] Inventor: Edward Fawess, Fresh Meadows, N.Y.

[73] Assignee: Lawrence Peska Associates, Inc., New York, N.Y. ; a part interest

[22] Filed: Feb. 12, 1975

[21] Appl. No.: 549,342

[52] U.S. Cl. ..... 5/327 R; 297/391

[51] Int. Cl.[2] ..... A47C 21/00

[58] Field of Search ..... 5/327, 327 B, 327 R; 108/44, 144, 160; 297/391

[56] References Cited

UNITED STATES PATENTS

| | | | |
|---|---|---|---|
| 1,349,941 | 8/1920 | Broome | 5/327 B |
| 2,172,609 | 9/1939 | Fogg | 108/144 X |
| 2,487,706 | 11/1949 | Happ | 5/327 B |
| 2,574,389 | 11/1951 | Harrold et al. | 297/391 |
| 3,063,064 | 11/1962 | Mace | 108/44 X |
| 3,123,935 | 3/1964 | Williams | 108/144 X |
| 3,357,729 | 12/1967 | Krueger | 108/160 X |
| 3,410,232 | 11/1968 | Krueger | 108/144 X |

*Primary Examiner*—Paul R. Gilliam
*Assistant Examiner*—Andrew M. Calvert

[57] ABSTRACT

A device to aid in supporting the torso when working in awkward and uncomfortable positions, such as the torso of a mechanic when working under the dashboard of an automobile.

4 Claims, 5 Drawing Figures

FIG. 1
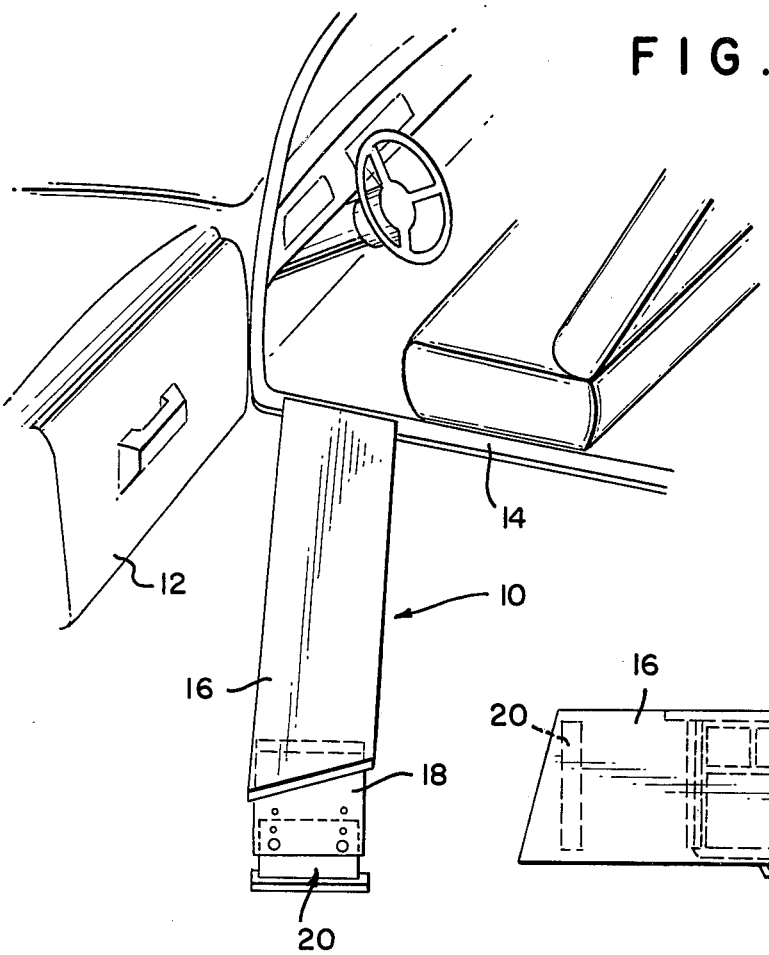
FIG. 2
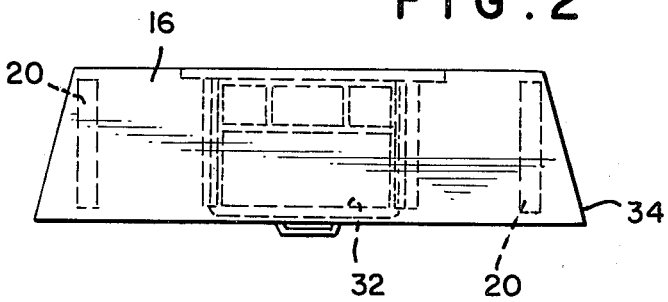
FIG. 3
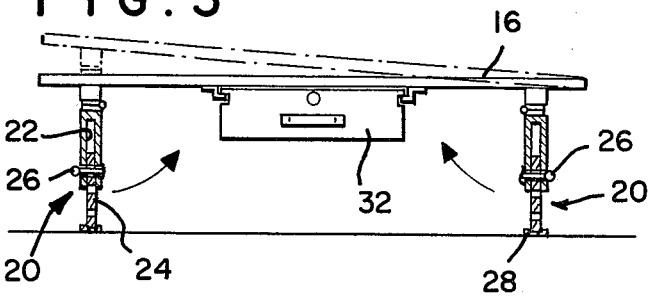
FIG. 5
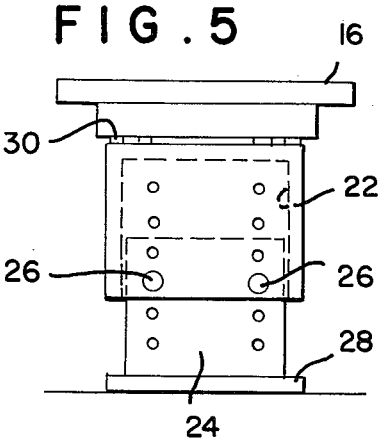
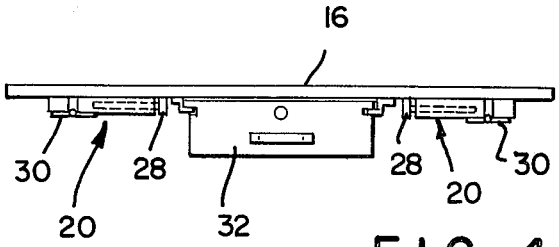
FIG. 4

TORSO SUPPORT

BACKGROUND OF THE INVENTION

This invention relates to a device adapted to be used when working under the dashboard of an automobile. More particularly, the invention relates to a device which can be placed in contact with the door step of an automobile when the door is open, which device will accommodate thereon and support the worker's body.

The prior art is replete with all types of crawler devices and portable beds and dining devices that are adapted to function in conjunction with automobiles and the like. The art does not, however, teach a device that will permit one to work on the underside of an automobile dashboard by supporting the torso such that the uncomfortable and awkward position of having to lay over the door step and transmission housing are obviated.

There are many occasions when working under the dashboard of a car is necessary— this is often dreaded by even those accustomed to such work due to the discomfort caused by having to drape one's body over the rise of the door step. Situations not connected with an automobile present the problem, such as in working under a built in sink in a kitchen cabinet.

SUMMARY OF THE INVENTION

It is accordingly an object of the instant invention to provide for a torso support that is especially adapted for working in awkward areas where the body cannot lie flat on the surface beneath the work area.

It is another object to provide for such a device which has adjustable height positions and lengths and which is substantially portable.

It is a further object to provide for such a device which is relatively uncomplicated, simple to operate and inexpensive.

These and other objects of the invention will become more apparent from the following detailed disclosure and claims, and in the accompanying drawings, in which:

FIG. 1 is a top plan view of the device in the ready to use position alongside an automobile;

FIG. 2 is a top perspective view of an embodiment of the invention;

FIG. 3 is a side elevational view partly in perspective of the embodiment shown in FIG. 2;

FIG. 4 is a side elevational view of the device of FIG. 3 in the closed position; and FIG. 5 is a side elevational view, partly in perspective of a leg section of the device.

Broadly speaking, the invention includes the provision of, a torso support device comprising a elongated main support means, a pair of leg support means, means pivotally mounting each of the leg support means at a location adjacent to each of the opposite ends of the device whereby each of the leg support means are adapted to be deployed in a folded and unfolded position to support the device, the leg support means including a telescopic portion whereby the length thereof may be adjusted.

Referring more particularly to the drawings, there is shown the torso support device 10 in the open position alongside an automobile, having an open door 12. The device 10 is lying substantially in contact with the door step guard 14. The device 10 need not, however, be necessarily used in conjunction with working on an automobile as stated earlier. The device 10 comprises a substantially flat support member 16 comprised of a single solid board or a walled housing adapted to accommodate extension support means or a secondary support 18 therein. In other words, the basic or elongated main support member 16 can be hollow and extendably removable therefrom there and thereout of can be secondary support means 18 having a smaller length, width and thickness, such that the latter can be slidably removed to afford greater length of support for the torso. Alternatively, the secondary support means 18 can also form a part of the main support means 16 and be hinged thereto for folding down to afford greater length. The main support means can also be a plurality of hinged sections. The main support means 16 will define at or near each longitudinal end thereof a set of leg means 20 operative to be in contact with the ground. The leg means 20 will in the preferred embodiment be pivotally engaged relative to the device 10. Preferably, comprised of a housing 22 in turn affixed to the underside the device 10. The leg means 20 can be such that they form telescopic means having extendable telescopic portions 24 that can be secured as to height in a variety of positions by locking means 26 such as a thumbscrew or the like. The foregoing arrangement facilitates setting up the device 10 at a variety of heights relative to the work area. If desired, friction means 28 such as a rubber stopper or base portion can be provided on the underside of the telescopic portion 24 to frictionally engage the ground to prevent slippage and movement of the device 10. In the preferred embodiment hinge or pivoting means 30 can be provided between the housing 22 and the underside of the device 10 so that the leg means 20 can be folded upward underside the device 10 as shown in FIG. 4. In a further embodiment of the invention as shown in FIGS. 2–4, one or more slidably removable compartments 32 can be provided on the underside of the device 10. In a further embodiment of the invention, the main support means 16 will have longitudinal end portions 34 that are not square relative to the longitudinal axis of the device 10. Each width end will define with each longitudinal end one angle greater than 90° but less than 180° and one angle less than 90°. In other words, the device will have a parallelogram or trapezoid shape so as to facilitate alignment with the door step portion 14 of a car. This, however, is not necessary but merely affords greater ease in those embodiments which might find particular application to the automotive industry.

The device 10 can be constructed of any rigid material such as wood, metal, plastic or the like.

While particular embodiments of the invention have been shown and described, it will be obvious to those skilled in the art that changes and modifications may be made without departing from the invention; all such changes and modifications which fall within the true spirit of the invention are intended to be covered by the claims.

What I claim is:

1. A torso support device comprising a substantially flat elongated main support means substantially in the shape of a trapezoid, for easy access to the side of an automobile a pair of leg support means, means pivotally mounting each of said leg support means at a location adjacent to each of the opposite ends of said device whereby each of said leg support means are adapted to be deployed in a folded and unfolded position to support said device, said leg support means including a telescopic portion whereby the length thereof may be adjusted such that opposite ends of said device can engage a surface at different elevation.

2. A device as defined in claim 1 including at least one storage compartment disposed on an undersurface of said main support means.

3. A device as defined in claim 1 wherein said main support means define a walled housing having at least one open end, secondary support means slidably engaged in said open end.

4. A device as defined in claim 1 wherein said main support means include a plurality of sections joined together by hinge means.

* * * * *